US005518377A

United States Patent [19]

Bougamont et al.

[11] Patent Number: 5,518,377

[45] Date of Patent: May 21, 1996

[54] VERTICAL METERING PUMP HAVING PISTON BIASING ELASTOMERIC GASKET

[75] Inventors: Jean-Louis Bougamont, Eu; Pierre Dumont, Houdain; Hervé Lompech, Incheville, all of France

[73] Assignee: Sofab, Le Treport, France

[21] Appl. No.: 513,737

[22] Filed: Aug. 10, 1995

[30] Foreign Application Priority Data

Aug. 11, 1994 [FR] France ..... 94 09949

[51] Int. Cl.[6] ..... F04B 7/00; F04B 53/16; F04B 9/14

[52] U.S. Cl. ..... 417/446; 417/480; 417/550; 92/130 B; 222/321.3; 222/321.9; 222/341

[58] Field of Search ..... 417/446, 479, 417/480, 547, 550, 569; 92/130 B; 222/321.3, 321.7, 321.9, 380, 385, 341

[56] References Cited

U.S. PATENT DOCUMENTS

| | | | |
|---|---|---|---|
| 3,359,917 | 12/1967 | Cooprider | 417/547 |
| 3,406,909 | 10/1968 | Pfeiffer | 222/321.7 |
| 4,347,953 | 9/1982 | Bauer | 417/479 |
| 4,452,379 | 6/1984 | Bundschuh . | |
| 4,991,747 | 2/1991 | Van Brocklin | 417/446 |
| 5,238,156 | 8/1993 | Andris | 222/207 |

FOREIGN PATENT DOCUMENTS

| | | |
|---|---|---|
| 2643338 | 8/1990 | France . |
| 1537436 | 12/1978 | United Kingdom . |

*Primary Examiner*—Michael Koczo
*Assistant Examiner*—Roland G. McAndrews, Jr.
*Attorney, Agent, or Firm*—Lowe, Price, LeBlanc & Becker

[57] ABSTRACT

A miniature metering pump of the type possessing a body provided with an inlet opening out into a metering chamber, associated with an inlet valve having a valve member, and with a piston having a plunger provided with an axial nozzle and flared at its bottom end to form a hood receiving a sealing gasket, its internal channel being associated with an outlet valve having a valve member, wherein said outlet valve member forms a portion of a single elastically deformable part that constitutes said gasket, shaped to have a bottom U-shaped ring assembled round the hood of the plunger, and connected at the top on the outside to a substantially cylindrical skirt for sealing and for returning the piston to its rest position, which skirt runs on from an annular flange for providing sealed connection with the body; and on the inside by a folded valve member that is generally conical or mitral-valve shaped, with a narrow top end carrying a cutout surrounded by a lip that opens to provide an outlet orifice.

11 Claims, 3 Drawing Sheets

VERTICAL METERING PUMP HAVING PISTON BIASING ELASTOMERIC GASKET

The present invention relates to a metering pump, and more particularly to a miniature metering pump that is used in a vertical position.

BACKGROUND OF THE INVENTION

Such miniature metering pumps already exist that are suitable for fitting to a receptacle and that comprise a body provided with an inlet associated with an inlet valve, and a plunger piston that is urged towards a rest position by a resilient return member, while also having a hollow rod or axial nozzle that projects from said body to serve both as a push rod and as a tube for ejecting substance, its internal channel being associated with an outlet valve. As a general rule, the inlet valve member is unbiased, however the valve member of the outlet valve is rated, i.e. biased towards a closed position by a resilient member. By virtue of a sealing gasket, the body and the piston co-operate to define a metering chamber which initially contains a certain volume of air that is generally exhausted, when priming the pump, by the outlet valve member being opened mechanically.

The resilient members are often in the form of metal springs and they are not always suitable for coming into contact with the substance, nor are they suitable for being subjected to the same reprocessing operations as the other parts of the pump if the pump is recycled.

OBJECTS AND SUMMARY OF THE INVENTION

An object of the invention is to provide a metering pump of simple structure, that avoids the above difficulty, and that operates reliably.

According to the invention, this object is achieved by means of a metering pump of the type possessing a body provided with an inlet which opens out into a metering chamber, and which is associated both with an inlet valve having a valve member, and with a piston having a plunger provided with an axial nozzle and flared at its bottom end to form a hood which receives a sealing gasket, its internal channel being associated with an outlet valve having a valve member, wherein said outlet valve member forms a portion of a single elastically deformable part which constitutes said gasket, which is shaped to have a bottom U-shaped ring assembled round the hood of the plunger, and which is upwardly connected:

on the outside to a substantially cylindrical skirt for sealing and for returning the piston to its rest position, which skirt runs on from an annular flange for providing sealed connection with the body; and on the inside to a folded valve member that is generally conical or mitral-valve shaped, with a narrow top end having a cutout surrounded by a lip that opens to provide an outlet orifice.

According to another characteristic, the pump also possesses a collar which closes the top opening of the body by means of a web carrying a guiding and retaining bearing forming a top abutment for the shoulder created by the hood on the plunger. Preferably, the collar carries an outside belt for connection to the receptacle. Also preferably, the annular flange of the gasket is engaged between the collar and the top rim of the body.

The skirt which is advantageously of substantially the same height as the stroke of the piston coming into bottom abutment, is held even in the rest position under sufficient tension.

According to an advantageous characteristic, in order to enable the outlet valve member to withstand sufficient pressure, the lip of the cutout co-operates with a circular central core for closing the outlet orifice and onto which it clamps. According to another characteristic, the outlet valve co-operates with a spreader projecting from the bottom portion of the metering chamber and designed to engage inside the fold valve to lift off its lip at the end of the downstroke of the piston immediately before the piston comes into abutment, thereby providing a passage between the metering chamber and the outlet orifice, which it thus opens by force.

Preferably, the core or seat is constituted by an axial stud placed at the bottom of the nozzle, the inside cavity of the hood communicating with the channel of the nozzle via at least one orifice pierced laterally through the root of the stud. Advantageously, the spreader is an axial chimney capable of passing around and along said stud, with the passage being formed by through openings optionally placed at the top edge of said chimney, in the form of crenellations.

According to another advantageous characteristic, the inlet valve includes a semi-rigid valve member received in a cavity of corresponding section in the metering chamber, the valve member supporting the spreader but being also connected to a tenon that is freely engaged in the inlet where it is retained by an internal narrowing.

The gasket is made as a single part, and it acts simultaneously to perform the functions of an outlet valve, a sealing member, and a return member for urging the piston towards the top of the metering chamber, with the spreader guaranteeing that the exhaust valve is opened mechanically.

BRIEF DESCRIPTION OF THE DRAWINGS

The invention is explained in the following description which refers to two advantageous examples, and which is accompanied by the drawings in which.

MORE DETAILED DESCRIPTION

Figure 1:
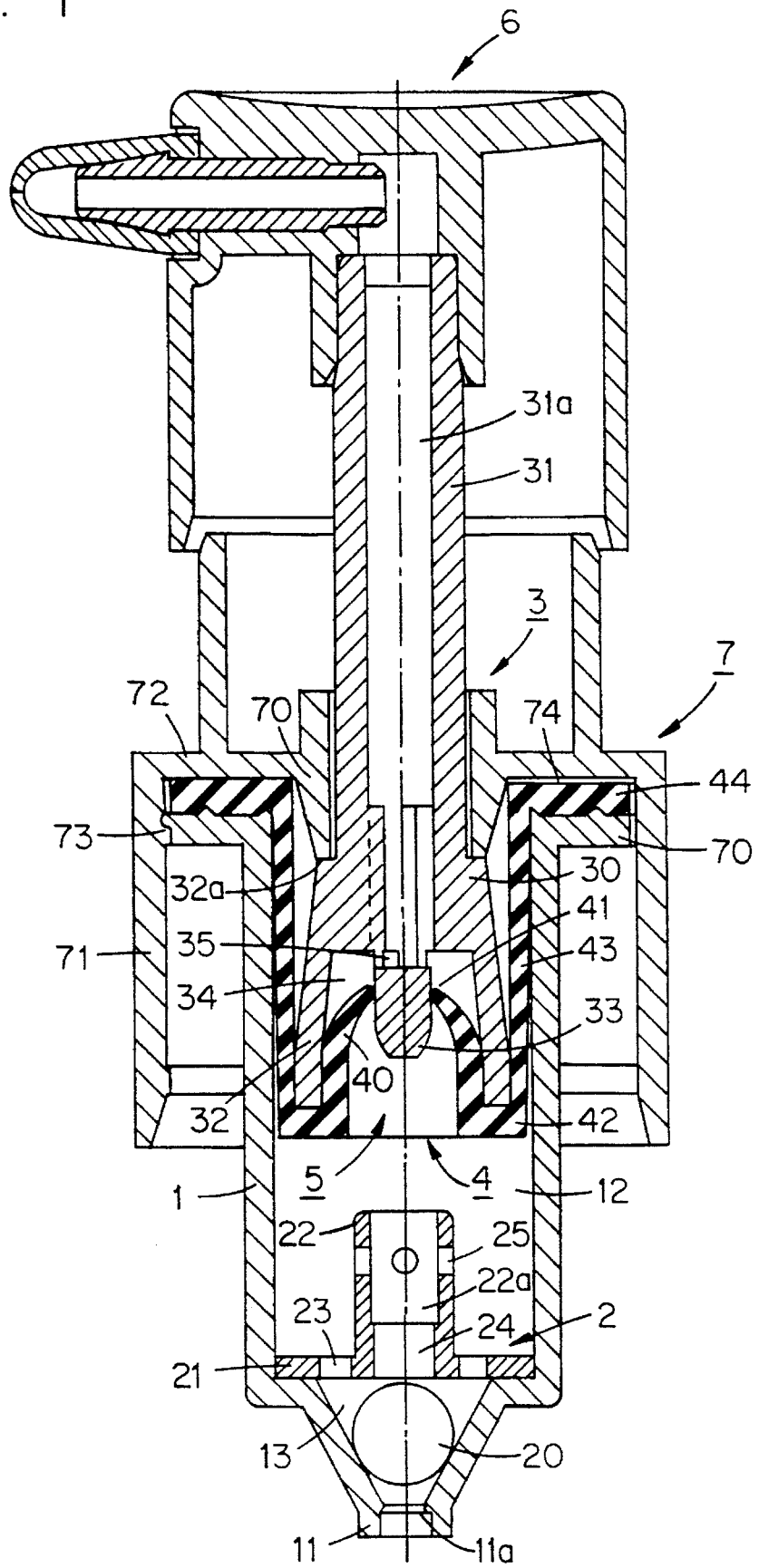
FIG. 1 is a longitudinal section through a first embodiment of the pump of the invention.

The pump shown in FIG. 1 comprises a body 1 that terminates at its top end in a flat top rim 10. The body 1 is provided with an inlet 11 associated with a bottom inlet valve 2, and it receives a piston 3. The piston 3 co-operates with a gasket 4 to create a top outlet valve 5, and inside the body 1, between the outlet valve 5 and the inlet valve 2, the piston defines a metering chamber 12.

The inlet 11 opens out into the chamber 12 via an inlet orifice 11*a*. It serves, either directly or via a dip tube, to take the substance to be dispensed from a receptacle or flask (not shown) on which the pump is designed to be mounted.

The piston 3 comprises a plunger 30 having an axial nozzle 31 projecting from the body 1, and in its bottom portion it has both a peripheral hood 32 creating a top shoulder 32*a*, and a central stud 33 serving as a seat for the outlet valve, the hood 32 defining a cavity 34 about the stud, which cavity communicates with the axial internal channel 31*a* of the nozzle 31 via at least one lateral orifice 35 formed at the root of the stud 33.

By way of example, the top end of the nozzle 31 carries a head 6 fitted with a dispensing endpiece.

The valve member of the outlet valve 5 is part of the gasket 4. This part comprises a substantially frustoconical axial fold 40 whose top end is provided with a cutout 41 bordered by a lip to define an outlet orifice, and whose bottom end connected, via a ring 42 having a generally U-shaped section around the hood, to a thin skirt or membrane 43 of piston 3 that is substantially cylindrical and is extended at the top by an annular flange 44 providing a sealed connection with the body 1. The gasket 4 is made out of an elastomer material so that the skirt is stretchable. The central stud 33 closes the outlet orifice of the valve 40, by pressing against its lip.

The pump in this example also includes a collar 7 that closes it and that is used for fixing it on a receptacle or a flask (not shown). The collar 7 is constituted by an inner axial bearing 70 connected to a belt 71 by a web 72. The adaptor 71 constitutes an outside skirt for screw- or snap-fastening.

The gasket 4 is clamped between the top flat rim 10 of the body and the collar; these two items are preferably fixed together by mutual engagement of pegs 73, the web 72 of the collar then clamping against the flange 44 of the gasket in sealed manner, with a slot 74 nevertheless providing a passage over the top face of the flange between the inside of the receptacle and the pump and on to the atmosphere via the bearing 70.

The bottom end of the bearing 70 forms a top abutment for the shoulder 32*a* of the plunger 30 whose hood 32 thus closes the outlet of the slot 74 when in its closed position, then also leaving the return skirt 43 of the gasket 4 under sufficient tension, corresponding to lengthening of about 30%.

The inlet valve 2 has a bead 20 as its valve member which rests on its seat in a cavity 13 formed in the bottom portion of the chamber 12 and a cage formed by a retaining washer 21, e.g. in frictional engagement against the side wall of the chamber 12. The cage leaves the bead free to move so that it can disengage the inlet orifice 11*a* so as to allow substance to flow therethrough. The washer 21 also carries a central chimney 22 on the top thereof. The chimney projects upwards inside the metering chamber 12 and it has an inside space 22*a* that opens out at its top end into the chamber. The washer 21 is provided with perforations 23 allowing the metering chamber 12 to communicate with the cavity 13, and the chimney 22 has through openings 24 and/or 25 communicating with the space 22*a*.

The chimney 22 is designed to engage in the fold of the valve 40 with a small amount of clearance around the stud 33, its top edge serving to spread open the cutout lip 41 when the piston comes into bottom abutment and the skirt is elongated by about 100%. This causes forced opening of the outlet orifice. The height of the chimney is therefore determined as a function of the size of the fold valve 40.

While the piston is moving upwards, the inlet valve member 20 rises under the effect of suction in the metering chamber 12 and subsequently it falls back under the effect of its own weight when the piston moves back down again, remaining pressed down by the pressure of substance in the chamber while the outlet valve 40 opens under the effect of the same pressure, closing finally under its own elasticity. However, if said internal pressure remains insufficient because there is compressible fluid inside the chamber 12, in particular air during first use thereof, the mechanical opening of the fold valve 40 nevertheless enables said fluid to be discharged.

The pump of FIG. 2 constitutes an embodiment of the invention that differs in particular with respect to its inlet valve. It is also a pump that does not have a vent, and which is mounted on a receptacle without any air intake, such as a receptacle having an internal flexible bag. Corresponding parts are given the same references and are not described again.

Figure 2A:
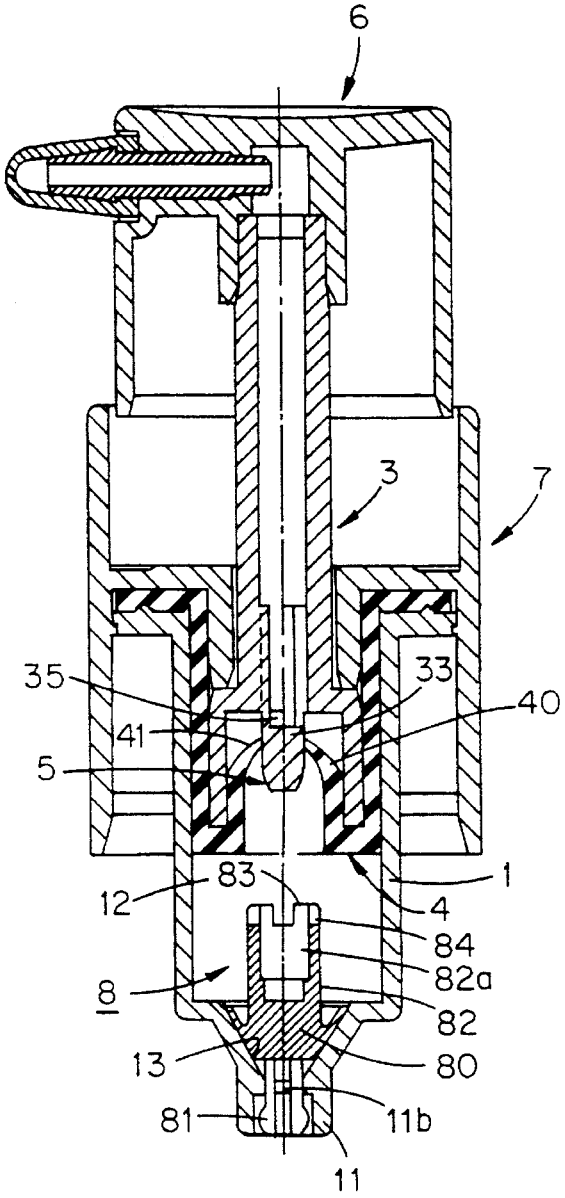
FIG. 2 is a section comprising views 2*a* to 2*d* showing the various stages in operation of a second embodiment of a pump of the invention.

In FIG. 2*a*, the pump is at rest.

Its inlet valve 8 has a valve member 80 whose closing portion is frustoconical, which member is made of plastomer or elastomer, and normally rests in a low closure position in a cavity 13 of corresponding shape. The valve member 80 is capable of being lifted, but it is connected at its bottom end to a tenon 81 that is engaged through the inlet 11 where it is held by a narrow portion 11*b*. In this example, the tenon is constituted by two flexible tongues.

Also in this case, the inlet valve 8 has a central chimney on its top surface, which chimney projects upwards and includes an inside space 82*a* in which the stud 33 is received. It is designed to engage in the fold valve 40 to open the outlet orifice mechanically. In this case, the chimney 82 is secured to the valve member 80 and its top edge is crenellated.

Figure 2B:
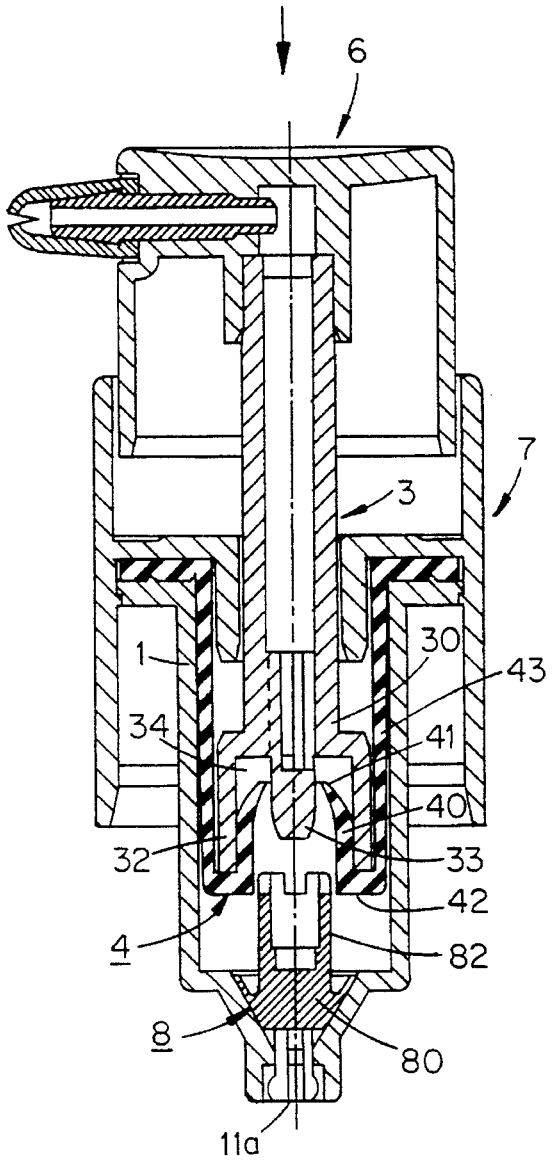

In FIG. 2*b*, pressure on the head has caused the plunger 30 to move down so that its hood 32 presses against the assembly ring 42 of the gasket 4, thereby stretching the skirt 43 downwards which becomes correspondingly thinner. The inlet valve 8 is then in its low position which corresponds to the inlet orifice 11*a* being closed.

This movement therefore normally causes a rapid rise in pressure inside the chamber 12 which forces the lip of the fold valve 40 to move away from the stud 33, thereby opening the outlet orifice, as shown in the figure.

Figure 2C:
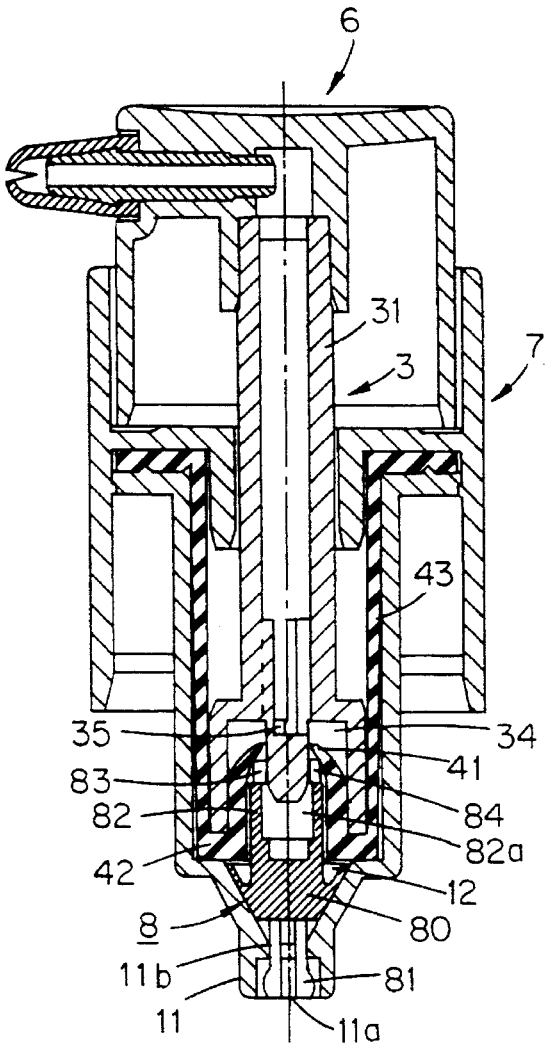

At the end of its down stroke, as shown in FIG. 2*c*, the ring 42 comes into abutment against the bottom of the metering chamber 12 and the fold valve 40 is engaged on the chimney 82 of the valve member 80, with the stud 33 penetrating into its inside space 82*a*.

Thrust from the "battlements" 83 of the chimney 82 deforms the top portion of the fold valve 40 level with its outlet orifice, thereby releasing an annular passage around the stud 33, and the crenellations 84 thus establish communication between the chamber 12 and the cavity 34. On first use, if the chamber 12 contains air, then air only is output via the cavity 34, the orifice 35, and the channel of the nozzle 31.

Figure 2D:
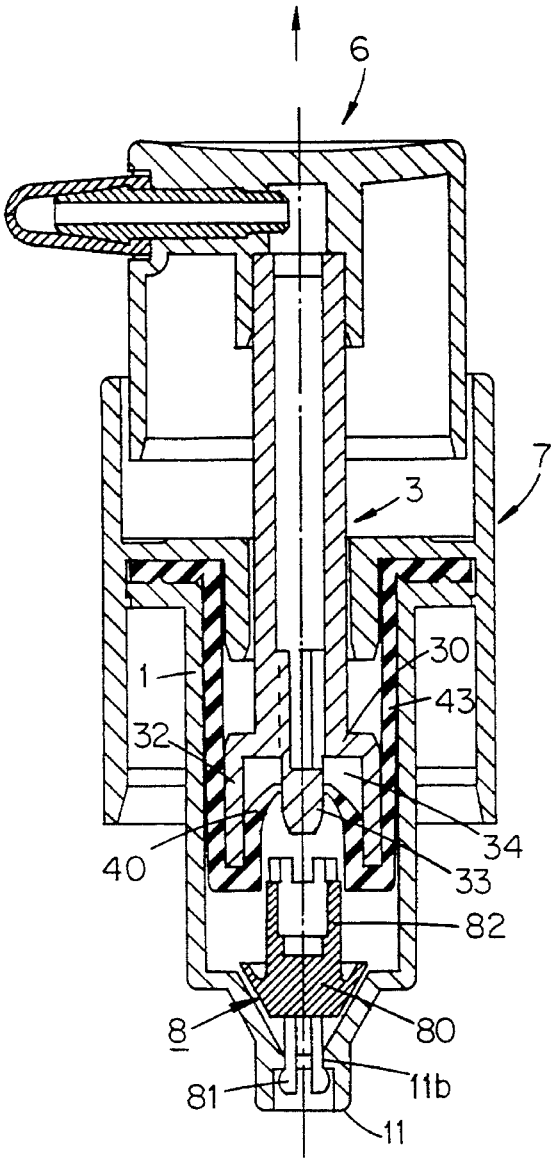

In FIG. 2*d*, the head 6 is progressively released: the skirt 43 returns the piston 3 upwards towards its initial position.

The upstroke of the piston 3 and the suction created thereby in the metering chamber 12 cause the inlet valve member 80 to open, but the tenon 81 being caught against the narrow portion 11*b* ensures that it disengages from the fold valve 40 so that the outlet orifice closes onto the stud 33 and substance is sucked in through the inlet 11.

When the now-full pump is again in the position of FIG. 2*a*, pressure equilibrium is achieved by a reduction in the inside volume of the receptacle, and the valve member 80 drops back to its closed position.

The pump is then ready to dispense a further quantity of substance. With the pump of FIG. 1, the same result would be achieved by allowing air to penetrate via the vent 74.

We claim:

1. A miniature metering pump of the type possessing a body provided with an inlet which opens out into a metering chamber, which is associated both with an inlet valve having a valve member, and with a piston having a plunger provided with an axial nozzle and flared at its bottom end to form a hood which receives a sealing gasket, said axial nozzle being associated with an outlet valve having a valve member, wherein said outlet valve member forms a portion of a single elastically deformable part which constitutes said gasket, which is shaped to have a bottom U-shaped ring assembled around the hood of an plunger, and which is connected:

on the outside of said piston to a substantially cylindrical skirt for sealing and for returning the piston to its rest position, which skirt includes an annular flange for providing sealed connection with the body; and on an inside of said piston to said outlet valve member which is generally conical shaped, with a restricted top end having a cutout surrounded by a lip that opens to provide an outlet orifice.

2. A pump according to claim 1, wherein the skirt is tensioned in its rest position by an elongation of about 30% and the non-tensioned length of the skirt is substantially equal to the displacement of the piston on its downstroke.

3. A pump according to claim 1, wherein the outlet valve co-operates with a spreader projecting from a bottom portion of the metering chamber and designed to engage inside the outlet valve member to lift off its lip at the end of the downstroke of the piston immediately before the piston comes into downstroke abutment, thereby providing a passage between the metering chamber and the outlet orifice, which opens by mechanical engagement.

4. A pump according to claim 3, wherein the inlet valve includes a semi-rigid valve member received in a cavity of corresponding section in the metering chamber, the valve member supporting the spreader but being also connected to a tenon that is freely engaged in the inlet where it is retained by an internal narrowing.

5. A pump according to claim 1, wherein the pump also possesses a collar which closes a top opening of the body by means of a web carrying a guiding and retaining bearing forming a top abutment for a shoulder created by the hood on the plunger.

6. A pump according to claim 5, wherein said collar carries an outside adaptor for connection to a receptacle.

7. A pump according to claim 5, wherein the annular flange of the gasket is engaged between the collar and a top rim of the body.

8. A pump according to claim 1, wherein the lip of the cutout co-operates with a circular central core of the piston for closing the outlet orifice and onto which it clamps.

9. A pump according to claim 8, wherein the core is constituted by an axial stud placed at the bottom end of the nozzle, a cavity inside the hood communicating with the channel thereof via at least one orifice pierced laterally at a root of the stud.

10. A pump according to claim 9, wherein the outlet valve co-operates with a spreader projecting from the bottom portion of the metering chamber and designed to engage inside the fold valve to lift off its lip at the end of the downstroke of the piston immediately before the piston comes into downstream abutment, thereby providing a passage between the metering chamber and the outlet orifice, which it thus opens by mechanical engagement, and wherein the spreader is an axial chimney capable of passing around and along said stud, with the passage being formed by through openings placed at the top edge of said chimney, in the form of crenellations.

11. A pump according to claim 10, wherein the inlet valve includes a semi-rigid valve member received in a cavity of corresponding section in the metering chamber, the valve member supporting the spreader but being also connected to a tenon that is freely engaged in the inlet where it is retained by an internal narrowing.

* * * * *